US006039286A

United States Patent [19]

Abrams et al.

[11] Patent Number: 6,039,286

[45] Date of Patent: Mar. 21, 2000

[54] INERTIAL STRAP TENSIONING APPARATUS AND METHOD FOR STRAPPING MACHINE

[75] Inventors: Jack Abrams, Arlington Hts.; Timothy Pearson, Antioch; Ronald Gurak, Oakwood Hills, all of Ill.

[73] Assignee: Illinois Tool Works Inc., Glenview, Ill.

[21] Appl. No.: 08/573,432

[22] Filed: Dec. 15, 1995

[51] Int. Cl.[7] ..... B65H 16/00

[52] U.S. Cl. ..... 242/564.4; 242/420

[58] Field of Search ..... 242/416, 417, 242/418, 420, 420.1, 420.2, 420.4, 564, 569.3, 564.4, 564.5

[56] References Cited

U.S. PATENT DOCUMENTS 2,306,660 12/1942 Gift, Jr. ..... 242/564.5
2,675,187 4/1954 Childress ..... 242/564
3,625,446 12/1971 Floyd ..... 242/420
4,928,897 5/1990 Satou et al. ..... 242/564.4

FOREIGN PATENT DOCUMENTS 62-185661 8/1987 Japan .

*Primary Examiner*—John P. Darling
*Attorney, Agent, or Firm*—Schwartz & Weinrieb

[57] ABSTRACT

A strap tensioning apparatus for a strapping machine comprises a large pulley which is power rotated during strap feeding by powered rollers pulling strap off of a feed strap coil. Tension is maintained on the end of the strap being pulled from the feed strap coil by inertial movement of the large pulley and other rotating elements after power to the rollers is stopped.

10 Claims, 2 Drawing Sheets

INERTIAL STRAP TENSIONING APPARATUS AND METHOD FOR STRAPPING MACHINE

CROSS REFERENCE TO RELATED APPLICATIONS

This invention is related to the following co-pending applications: Obstruction Removal Apparatus and Method for Strapping Machine Ser. No. 08/573,205, filed Dec. 15, 1995, Two Stage Gripping Apparatus and Method for Strapping Machine Ser. No. 08/583,459, filed Dec. 15, 1995 Strap Path Access Apparatus and Method for Strapping Machine Ser. No. 08/573,457 filed Dec. 15, 1995 Strap Severing and Ejecting Apparatus and Method for Strapping Machine Ser. No. 08/573,326, filed Dec. 15, 1995.

BACKGROUND OF THE INVENTION

1. Field of the Invention

The present invention relates to strapping machines for positioning and securing a binding strap around an object or objects, and more specifically, the present invention relates to an apparatus and method for maintaining tension on a strap end by mean of the inertia of rotating members of the apparatus.

2. Description of Related Art

Strap being pulled off of a strap coil of a strapping machine must be maintained at a particular tension for proper functioning of the strapping machine. In the past, several different types of apparatus and methods have been proposed for maintaining tension on the strap.

One prior art device requires a dancer arm with a spring clutch to apply a force to a strap segment, and belt brakes to stop coil rotation after cessation of strap pulling from the strap coil, in order to prevent slack and insufficient strap tension.

Another prior art device requires electrical or electromagnetic brakes to stop coil rotation.

Other prior art devices require electrical brakes to stop coil rotation and also require constantly rotating pull off wheels which constantly slip on the strap.

All of these prior art systems typically work only in the forward direction of strap pull, where strap is fed off of the strap coil.

The prior art tensioning devices do not function in the reverse, or rewinding direction.

All of the prior art systems are hampered by a general mechanical complexity. Dancer arms which function properly for various strap speeds and varying strap acceleration and deceleration conditions are difficult to design, and difficult to keep in adjustment. Also, the braking systems are generally complex, particularly the sensing and signalling systems for application and removal of the braking action against the coil.

The present invention solves the problem of maintenance of proper strap tension by providing an inertial system, eliminating the need for complex dancer arm and braking systems.

Because the strap is held in a substantially constant tension condition, the formation of strap loops which would otherwise fall off of the strap coil is prevented. Strap cross-over on the strap coil is avoided. Additionally, slack is removed from the strap gently, eliminating abrupt forces which would otherwise be applied to the strap and machine components during conventional strap tensioning.

The invention also solves the problems associated with stoppage of rotation of the rotating elements of the strapping machine, and rewinding strap out of the machine and back onto the coil.

SUMMARY OF THE INVENTION

The present invention utilizes the inertia of the rotating elements of the strap coil to drive the drive motor shaft after electric power to the drive motor is stopped. The inertia of the previously electrically motor driven rotating strap coil is transferred by a pulley and belt arrangement back through the drive motor shaft, turning the drive motor shaft in the forward direction, thereby continuing to maintain tension on the strap end. Friction and other resistive forces in the system will cause the rotating members to rotate at a decreasing rate, and eventually come to a gradual stop.

Electrically powering the drive motor in the reverse direction moves the belt in the reverse direction. A one-way clutch connects the belt to the strap coil, reversing the rotation of the strap coil in order to withdraw strap from the strapping machine and rewind it onto the strap coil.

It is an object of the present invention to maintain tension on a strap in a strapping machine without the need for a dancer arm tensioning device. It is another object of the invention to provide for the stoppage of rotating members of the strapping machine without the need for electric or electromechanical braking devices. It is a further object of the invention to provide for strap rewinding by reversal of the direction of the drive motor.

These and other objects of the invention will be met by the apparatus and method described below.

Various other objects, features, and attendant advantages of the present invention will be more fully appreciated from the following detailed description when considered in connection with the accompanying drawings in which like reference characters designate like or corresponding parts throughout the several views, and wherein:

DESCRIPTION OF THE PREFERRED EMBODIMENT

Figure 1:
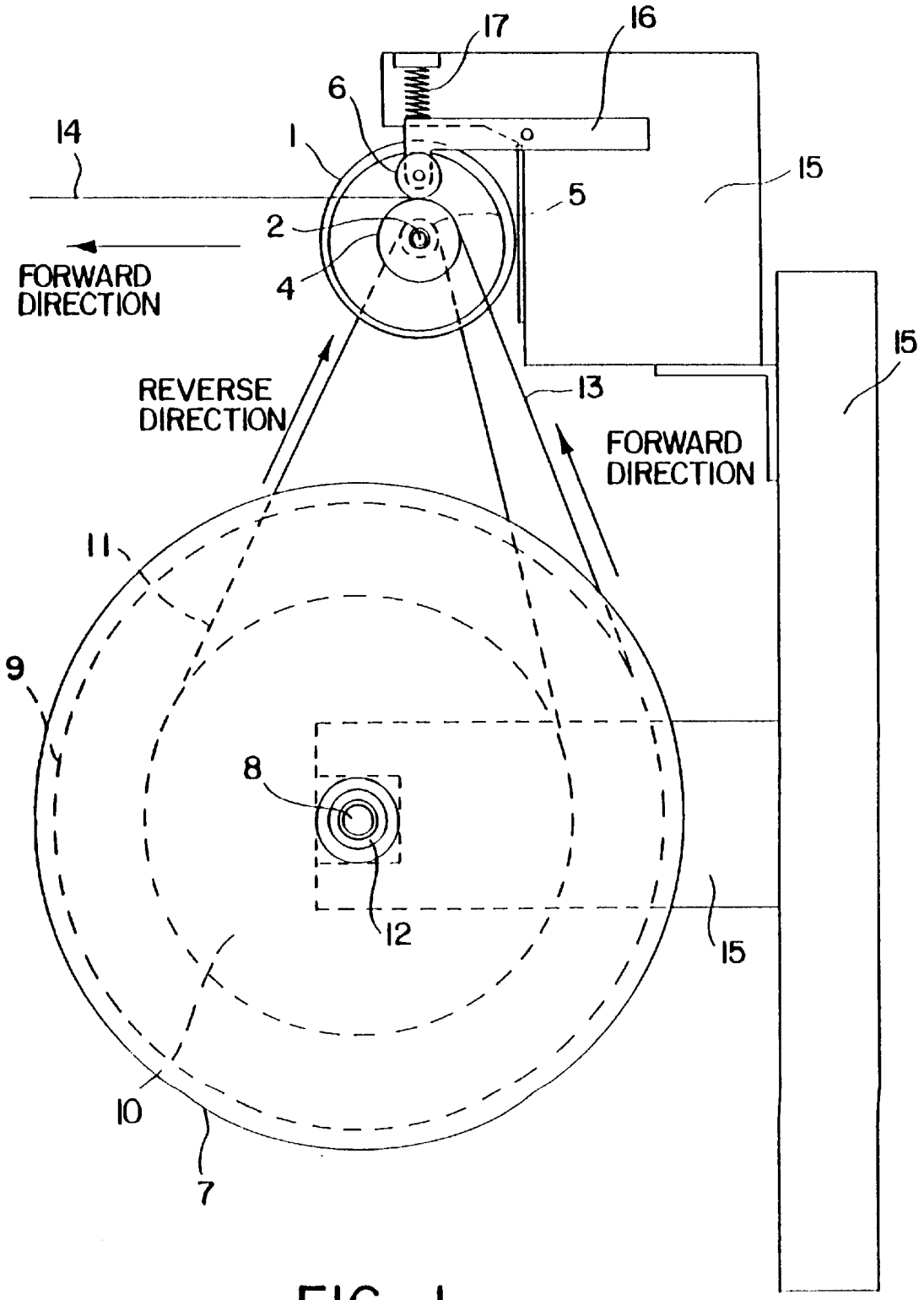
FIG. 1 is a front view of the invention described herein.

Referring to FIG. 1, the invention comprises a frame 15 and drive motor 1 having a first motor shaft 2. A driven wheel 4 is attached to the first motor shaft 2. A pinch roller 6 attached to a pinch roller arm 16 is matable with the driven wheel 4. The force by which the pinch roller arm 16 and pinch roller 6 are urged against the driven wheel 4 may be adjusted by a pinch roller spring 17. Supplying electric or other power to the drive motor 1 to drive it in the forward direction causes forward rotation of the first motor shaft 2. Driven wheel 4 is thereby driven in the forward direction. A strap 13 having a strap loose end 14 is pulled off of a strap coil 9, by the physical connection of the strap with the rotating driven wheel 4 and the pinch roller 6. Unwinding of the strap 13 causes the strap coil 9 to rotate in a forward direction.

Figure 2:
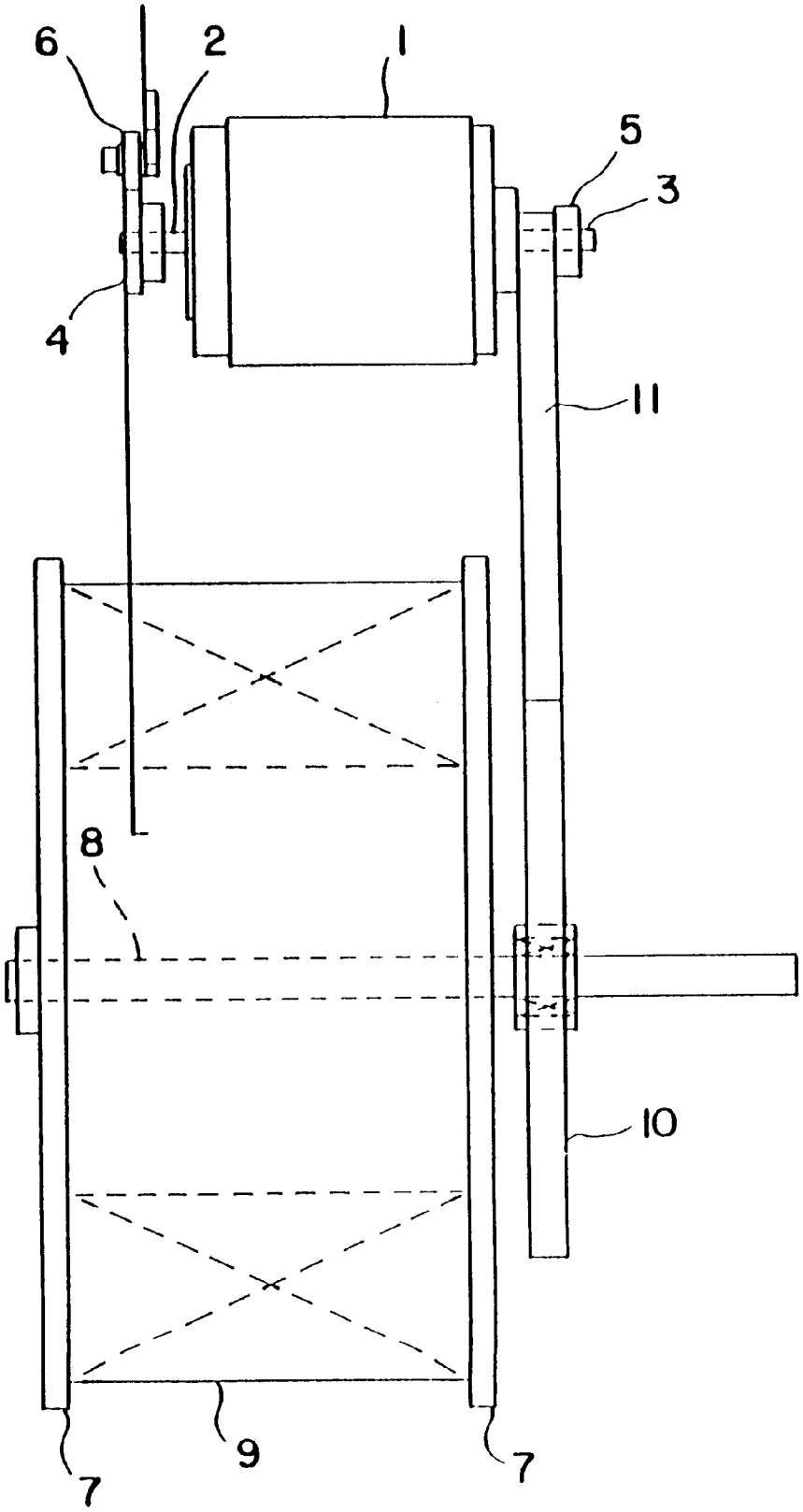
FIG. 2 is a side view of the invention described herein.

Referring now to FIG. 2, a first pulley 5 is connected with a second motor shaft 3. The first pulley 5 and second motor shaft 3 are connected through a drive belt 11, chain, or other means to a second pulley 10. The second pulley 10 is attached to a flange set fixed shaft 8 by means of a one-way clutch 12. Flange set 7 cooperates to form a strap coil 9 for holding an amount of strap in a coiled arrangement.

In operation, the strap loose end 14 is mechanically held between the driven Wheel 4 and the pinch roller 6. The pinch roller 6 is movable with respect to the driven wheel 4 in a direction generally along a line connecting their two centers, in order to exert an appropriate force against the strap 13 through the urging of the pinch roller spring 17 in connection with the pinch roller arm 16 against the pinch roller 6. Electric power supplied to the drive motor 1 causing it to rotate in the forward direction also causes rotation of the first motor shaft 2 and the driven wheel 4 in the forward direction. The strap 13 is thereby pulled from the strap coil 9, causing rotation of the strap coil 9, flange set 7, and flange set fixed shaft 8 in the forward direction. The flange set fixed shaft 8 is connected by the one-way clutch 12, in one embodiment a roller-type clutch, to the large second pulley 10. The flange set fixed shaft 8 and the second pulley 10 may share a common central axis. A drive belt 11 or other means such as a chain connects the second pulley 10 to the first pulley 5 which is mounted on the second motor shaft 3 of the drive motor 1. In one embodiment, the first pulley 5 has a common central axis with the driven wheel 4.

In one embodiment, the ratio of the first pulley 5 pitch diameter and the second pulley 10 pitch diameter is greater than the ratio of the maximum strap coil 9 diameter and the driven wheel diameter 4. As strap 13 is pulled from the strap coil 9, the diameter of the strap coil 9 decreases. The strap coil 9 therefore rotates at a correspondingly increasing speed. However, due to the constant speed of the driven wheel 4 and the pinch roller 6, the speed of the strap coil 9 rotation does not affect the speed at which the strap 13 is taken off of the strap coil 9.

Because of the one-way clutch 12, the second pulley 10 is overrunning on the flange set fixed shaft 8 during forward rotation of the drive motor 1. Strap tension is maintained during this phase of operation as strap 13 is being pulled from the strap coil 9 by the driven wheel 4.

When electric power to the drive motor 1 is discontinued, the inertia of the strap coil 9 and flange set 7 will continue to drive the drive motor 1 in the forward direction. This driving force is provided from the rotating strap coil/flange set system through the flange set fixed shaft 8, to the one-way clutch 12, to the second pulley 10, to the drive belt 11, to the first pulley 5, to the second motor shaft 3, and eventually to the drive motor 1 itself. Rotation of the drive motor 1 in this forward direction causes the driven wheel 4 to continue to pull strap 13 under tension from the strap coil 9. Friction and other resistant forces eventually cause the rotating members to cease rotating, whereby the system comes to a rest position. However, the strap loose end 14 is as a consequence maintained under constant tension.

Removal of the strap 13 from the strapping machine and rewinding of the strap 13 onto the strap coil 9 may be accomplished by electrically or otherwise powering the drive motor 1 in the reverse direction after releasing tension of the pinch roller 6 from the strap 13 and driven wheel 4. The drive motor 1 will now drive the first pulley 5, which drives the drive belt 11, the second pulley 10, the one-way clutch 12 and the flange set fixed shaft 8, thereby driving the flange set 7 and the strap coil in the reverse direction, causing the strap 13 to be removed from the strapping machine and rewound onto the strap coil 9.

The invention described above encompasses the range of equivalents to which it is entitled, and is only limited by the following claims.

We claim:

1. An inertial strap tensioning system for a strapping device, comprising:

a reel;

a coil of strap material disposed upon said reel;

drive means engaged with a portion of said strap material which has been uncoiled from said reel for pulling additional strap material from said coil of strap material disposed upon said reel; and means interconnecting said reel and said drive means for inertially driving said drive means so as to continue pulling additional strap material from said coil of strap material when power to said drive means is terminated.

2. An inertial strap tensioning system as set forth in claim 1, wherein said drive means comprises:

a driven wheel; and a pinch roller cooperatively engaged with said driven wheel for drivingly capturing said portion of said strap material, which has been uncoiled from said coil of strap material disposed upon said reel, therebetween.

3. An inertial strap tensioning system as set forth in claim 2, wherein:

said pinch roller is mounted upon a pinch roller arm; and spring means biases said pinch roller arm toward said driven wheel so as to bias said pinch roller into engagement with said driven wheel.

4. An inertial strap tensioning system for a strapping device, according to claim 2, further comprising:

an externally powered drive operatively connected to said driven wheel for driving said driven wheel such that said driven wheel, cooperatively engaged with said pinch roller, can pull said additional strap material from said coil of strap material disposed upon said reel by driving said portion of said strap material which has been uncoiled from said coil of strap material disposed upon said reel.

5. An inertial strap tensioning system as set forth in claim 4, wherein:

said externally powered drive comprises a drive motor.

6. An inertial strap tensioning system for a strapping device, according to claim 5, wherein:

said drive motor comprises a first motor shaft; and said driven wheel is attached to said first motor shaft wherein forward rotation of said drive motor by application of external power rotates said first motor shaft and said driven wheel in a forward direction such that said driven wheel and said pinch roller cooperatively acting against said portion of said strap material, which has been uncoiled from said coil of strap material disposed upon said reel, causes said additional strap material to be pulled under tension from said coil of strap material disposed upon said reel.

7. An inertial strap tensioning system for a strapping device, according to claim 6, wherein:

said drive motor comprises a second motor shaft;

said reel, upon which said coil of strap material is coiled, comprises a laterally spaced flange set; and said means interconnecting said reel and said drive means comprises a shaft fixed to and rotatable with said reel, a one-way clutch mounted upon said shaft fixed to said reel, a first pulley mounted upon said second motor shaft, a second pulley operatively connected to said one-way clutch, and a drive belt interconnecting said second pulley with said first pulley and being driven in said forward direction by rotation of said reel, said shaft, said one-way clutch, and said second pulley;

wherein, upon cessation of said application of said external power to said drive motor, inertial rotation of said reel, by means of said shaft, said one-way clutch, and said second pulley, drives said drive belt, said first pulley, said second motor shaft, said first motor shaft, and said driven wheel such that said driven wheel, along with said pinch roller, continue to pull strap material under tension from said coil of strap material disposed upon said reel until rotational motion ceases due to resistive forces.

8. An inertial strap tensioning system for a strapping device, according to claim 7, wherein:

said drive motor comprises a reversible drive motor so as to be drivable in a reverse direction by said application of said external power such that said reel is drivable, through means of said second motor shaft, said first pulley, said drive belt, said second pulley, said one-way clutch, and said shaft upon operation of said drive motor in said reverse direction, in said reverse direction so as to remove a leading end portion of said strap from a strapping machine and thereby rewind an uncoiled portion of said strap back onto said coil of strap material disposed upon said reel.

9. A method of inertially driving a reel of coiled strap material, comprising the steps of:

providing a reel;

coiling strap material upon said reel;

providing a drive means for initially rotating said reel in a first direction so as to uncoil said coiled strap material, disposed upon said reel, from said reel;

engaging said drive means with a portion of said strap material which has been previously uncoiled from said coiled strap material disposed upon said reel so as to exert a pulling force upon said uncoiled portion of said strap material and thereby uncoil additional strap material from said coil of strap material disposed upon said reel; and providing means interconnecting said reel and said drive means for inertially driving said drive means so as to continue pulling additional strap material from said coil of strap material disposed upon said reel when power to said drive means is terminated.

10. The method as set forth in claim 9, further comprising:

driving said drive means in a second opposite direction so as to rotate said reel, through said means interconnecting said reel and said drive means, in said second opposite direction and thereby remove a leading end portion of said strap from a strapping machine and rewind an uncoiled portion of said strap material back onto said coil of strap material disposed upon said reel.

* * * * *